US005276458A

United States Patent [19]

Sawdon

[11] Patent Number: 5,276,458

[45] Date of Patent: Jan. 4, 1994

[54] DISPLAY SYSTEM

[75] Inventor: David Sawdon, Winchester, Great Britain

[73] Assignee: International Business Machines Corporation, Armonk, N.Y.

[21] Appl. No.: 60,675

[22] Filed: May 13, 1993

Related U.S. Application Data

[63] Continuation-in-part of Ser. No. 696,892, May 7, 1991, abandoned.

[30] Foreign Application Priority Data

May 14, 1990 [GB] United Kingdom ..... 90305158.9

[51] Int. Cl.[5] ..... G09G 3/00

[52] U.S. Cl. ..... 345/132; 395/112

[58] Field of Search ..... 395/112; 340/811-; 345/132, 204; 358/148

[56] References Cited

U.S. PATENT DOCUMENTS 4,855,728 8/1989 Mano et al. ..... 340/784 J X
4,964,069 10/1990 Ely ..... 340/814 X
4,998,100 3/1991 Ishii ..... 340/784 J
5,097,257 3/1992 Clough et al. ..... 340/814

*Primary Examiner*—Ulysses Weldon
*Attorney, Agent, or Firm*—Joscelyn G. Cockburn

[57] ABSTRACT

A display system is described, comprising a display device (88) for generating a visual output in response to a plurality of data signals defining the data to be displayed, a display adapter circuit (92) for generating the data signals in a form specified by control data identifying the display device (88), an output port (94) for connecting the data signals from the display adapter circuit to the display device (88) and for connecting the control data from the display device (88) to the display adapter circuit (92), characterized in that the display system further comprises a non-volatile memory (9) located in the display device (88) for storing the control data in the form of a plurality of control codes, and communication logic (95) for communicating a control code between the memory and the output port (94) in response to a command signal (21) generated by the display adapter circuit (92). The communication logic comprises a serial data link (3) for communicating the control code between the display device and the output port, device logic (97) located in the display device for communicating the control code between the memory and the serial data link, and adapter logic (96) located in the display adapter circuit for communicating the control code between the serial data link and the display adapter circuit.

20 Claims, 2 Drawing Sheets

DISPLAY SYSTEM

This is a continuation-in-part of copending application Ser. No. 07/696,892 filed on May 7, 1991, now abandoned.

BACKGROUND OF THE INVENTION

1. Field of the Invention

The present invention is related to a display system in which control data is communicated between a computer system and a display device.

2. Prior Art

The control data includes parameters for specifying the geometry and resolution of an image presented on the display device. In a display system comprising a raster-scanned display device such as a Cathode Ray Tuhre (CRT) display device, these parameters are determined by the rates and amplitudes of horizontal and vertical scan signals generated for producing the raster scan by electrical circuits in the display device. In order to generate the image, the scan signals are synchronised to video signals from a video source such as a computer system by synchronisation (sync) pulses also generated by the video source.

Some display devices can only operate in a single display mode in accordance with a single set of parameters. Other display devices can be configured to operate in any one of a number of display modes characterised by different sets of parameters. The latter will hereinafter be referred to as multiple mode display devices. In a display device controlled by a computer system it is desirable for the computer system to identify the type of the display device so that appropriate video and sync signals can be generated. Many examples of such computer systems, including the IBM PS 2 range, comprise a video graphics adapter (VGA) having an output port for connecting video and sync signals to a display device. The VGA also has logic responsive to the manner in which identification pins in the output port are terminated when connected to the display device. The logic identifies the type of display device connected to the VGA adapter from these terminations.

UK Patent No. 2,162,026 describes an example of a display system employing a multiple-mode display device receiving video and sync signals from a computer system display adapter. The display device can operate in any one of four display modes. The computer system can be instructed to provide sync pulses of either positive or negative polarities. Each polarity combination indicates a different display mode. The display device includes decoding logic for configuring the display device to operate in a particular display mode in response to predetermined sync pulse polarities.

The display systems of the prior art have the disadvantage that the display interfaces of the prior art can identify, and therefore generate appropriate control signals for, only a limited number of different display devices. This limitation arises because the number of pins available for display device identification and control is limited by the physical form of the output port.

SUMMARY OF THE INVENTION

An object of the present invention is therefore to provide a display system having a display adapter which is potentially compatible with an unlimited variety of display devices.

In accordance with the present invention, there is now proposed a display system comprising a display device for generating a visual output in response to a plurality of data signals defining the data to be displayed, a display adapter circuit for generating the data signals in a form specified by control data, the control data being unique to the display device, an output port for connecting the data signals from the display adapter circuit to the display device and for connecting the control data from the display device to the display adapter circuit, characterised in that the display system further comprises a non-volatile memory located in the display device for storing the extended control data in the form of a plurality of control codes, and communication logic for communicating the control codes between the memory and the output port in response to command signals generated by the display adapter circuit. This has the advantage that, since the control data such as the signal timing requirements of any new display device can now be stored in the form of digital control codes held within the memory of the display device, the display system programming does not require updating every time a different display device is connected to the output port. Instead, the display adapter can now read the new timing requirements from the memory of the new display device for the purpose of generating video and sync signals for correctly driving the new display device.

Preferably, the communication logic comprises a serial data link for communicating the control code between the display device and the output port, device control logic for communicating the control code between the memory and the serial data link, and adapter control logic for communicating the control code between the serial data link and the display adapter circuit. This has the advantage that, where the display system comprises a multiple mode display device, the display adapter circuit can use the serial link to configure the display device to operate in a desired display mode.

BRIEF DESCRIPTION OF THE DRAWING

An example of the present invention will now be described with reference to the accompanying drawings in which.

DESCRIPTION OF THE PREFERRED EMBODIMENT(S)

Figure 1:
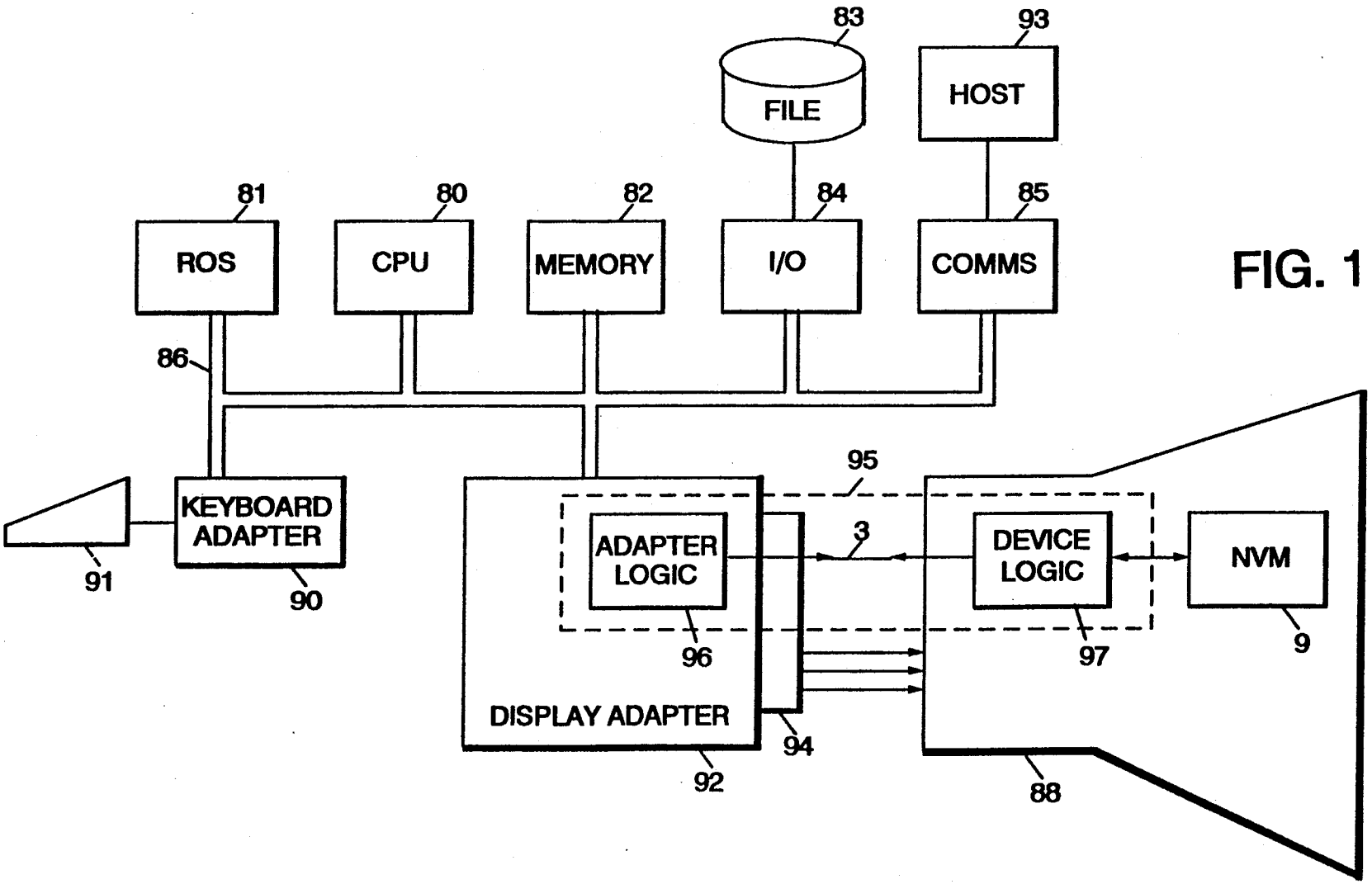
FIG. 1 is a block diagram of a computer system incorporating a display system including a display device.

FIG. 1 illustrates an example of a computer system incorporating a display system having a CRT display device 88.

The computer system includes a central processing unit (CPU) 80 for executing programmed instructions. A bus architecture 86 provides a data communication path between the CPU 80 and other components of the display system. A read only memory (ROS) 81 provides secure storage of data. A random access memory 82 provides temporary data storage. Data communication with a host computer system 93 is provided by a communication adapter 85. An I/O adapter 84 enables data to pass between the bus architecture 86 and a peripheral device such as a disk file 83. A user can operate the computer system using a keyboard 91 which is connected to the bus architecture 86 by a keyboard adapter 90. The keyboard 91 is connected to keyboard adapter 90. The CRT display device 88 provides a visual output from the display system. A display adapter 92 generates video and sync signals at an output port 94 for enabling the display device 88 to generate the visual output.

In accordance with the present invention, the display device 88 comprises a Non-Volatile Memory (NVM) 9 for storing display information in the form of digital codes. The display information is communicated between the display device 88 and the display adapter 92 along a serial link 3 which is controlled by communication logic 95. The serial link 3 is separate from the lines carrying the video and sync signals from the display adapter 92 to the display device. The communication logic 95 is divided into adapter logic 96 and device logic 97. In operation, the adapter logic 96 initiates commands for both reading and writing data to the NVM 9 and the device logic 97 responds accordingly.

Figure 2:
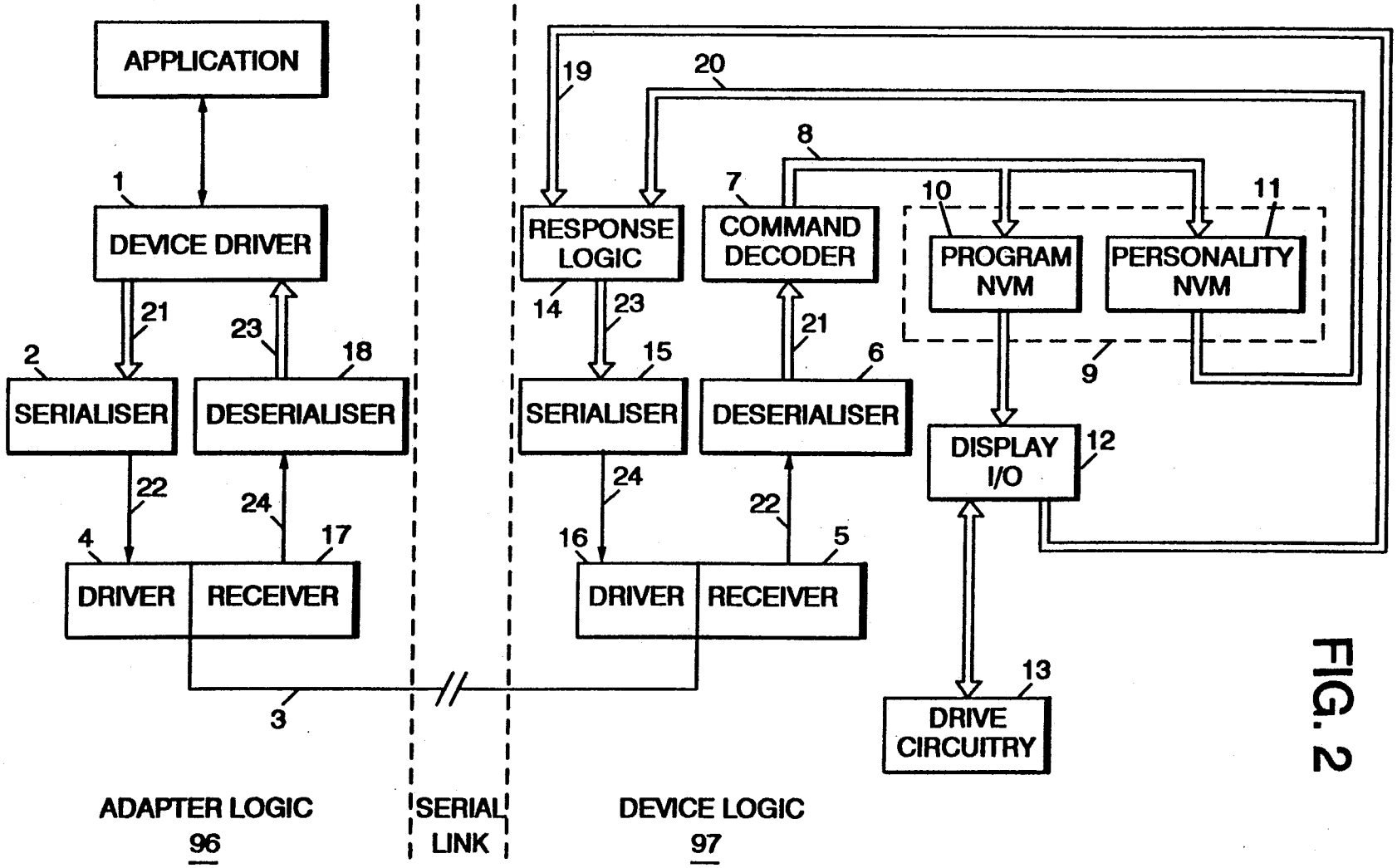
FIG. 2 is a block diagram of communication logic for communicating display information between the display adapter and the display device.

The communication logic 95 will now be described in further detail with reference to FIG. 2. The adapter logic 96 comprises a device driver 1 for generating a command code 21 in response to a program instruction. A first serialiser 2 translates the command code 21 into a command bit stream 22 for a first line driver 4 to communicate to the device logic 97 along the serial link 3. The device logic 97 comprises a second receiver 5 for detecting the command bit stream 22. A second deserialiser 6 translates the command bit stream 22 back into the command code 21. A command decoder 7 decodes the command code 21 into an NVM address 8. Address space in the NVM 9 is divided into a personality Nvm 11 and a program NVM 10.

In operation, the deserializer 6 deserializes the command bit stream. The deseralized bit stream is decoded by the command decoder 7 to form an address for the program NVM. The location in the program NVM specified by the address contains a control code for the display I/O. The display I/O includes a DAC (digital to analog converter) for converting the selected control code into a drive level for analog drive circuitry. Thus, by addressing different control codes to the DAC, the operating parameters of the drive circuitry can be adjusted to optimize operation (i.e., trimmed).

The personality NVM 11 contains identification codes for providing the display system with a specification of the display device 88 connected to the display adapter 92. Each identification code is stored in a different address location. The identification codes include coded timing parameters for enabling the display adapter 92 to generate appropriate video and sync signals. Specifically, the timing parameters include sync pulse widths, active video periods, and blanking intervals. Preferably, the identification codes also include a coded transfer parameter for indicating the maximum rate at which the device logic 97 can read or write data to the serial link 3. By reading the transfer parameter before issuing any further commands, the adapter logic 96 can ensure that data is subsequently transferred between the display device 88 and the display adapter 92 at a rate which is compatible with both the adapter logic 96 and the device logic 97. Specifically, when the display system is initialized, the adapter logic sends a request for the identification codes to the device logic via the serial line 3 at a default data rate. In response to the request, the device logic returns the identification codes including the transfer parameter also at the default data rate. The adapter logic decodes the received transfer parameter to determine the maximum data rate compatible with the display logic and the adapter logic and makes subsequent communications with the display logic at the determined rate. Typically, although not necessarily, the default data rate will be relatively low. The default data rate is a predetermined data rate at which the adapter logic 96 and the device logic 97 transmit data, respectively. Each timing parameter is stored in the form of a sixteen bit identification code. Fifteen bits of the code specify the value of the timing parameter and the sixteenth bit specifies the polarity. It will be appreciated that less critical timing parameters may be stored in the form of eight bit codes or less. The personality NVM stores several sets of timing parameters corresponding to different display modes of the display device.

The program NVM 10 stores control codes for instructing a display input/output (I/O) circuit 12 to adjust drive signals generated by drive circuitry 13 in the display device. Examples of such drive signals directly affect the height, width, and brightness of the visual ouput from the display device 88. Each control code is stored in a different address location. By instructing the display I/O circuit 12 with appropriate control codes, the visual output of the display device 88 can be switched between different display modes under the control of a computer program. Preferably the program NVM 10 also stores control codes for instructing the display I/O circuit 12 to generate sample codes representative of drive signal magnitudes at predetermined nodes of the drive circuitry 13. It will be appreciated that such control codes may be used to automate diagnostic methods for testing the operation of the display device 88 after manufacture or repair.

When the adapter logic 96 issues a read command, the device logic 97 responds by placing an appropriate response code 23 on the serial link 3. The response code 23 may either be an identification code 20 from the personality NVM or a sampled data code 19 from the display I/O circuit 12 depending on the nature of the read command. For implementing such a response, the device logic 97 comprises parity logic 14 for adding a parity bit to the response code 23. A second serialiser 15 translates the response code 23 into a response bit stream 24. The response bit stream 24 is placed on the serial link 3 by a second line driver 16. In the display adapter 92, a first receiver 17 detects the response bit stream 24 on the serial link 3. A first deserialiser 18 translates the detected response bit stream 24 back into the response code 23 which is decoded by the device driver 1.

The first serialiser and the first deserialiser of the adapter logic can be combined in a single integrated circuit module, and a similar module can be used to implement the second serialiser and the second deserialiser. The first line driver and the first receiver can also be incorporated in a single integrated module, and a similar driver/receiver module can be used to implement the second line driver and the second receiver.

The adapter logic 96 can be configured to receive a response from the device logic 97 in either a "Handshaking" mode or a "Data-streaming" mode. In the "Handshaking" mode, the device logic 97 waits for the adaptor logic to place an acknowledgement code on the serial link 3 before sending the next byte of the response. In the "Data-streaming" mode, the device logic 97 waits for the adapter logic 96 to acknowledge receiving a block of bytes of the response before sending the next block. The control data, such as the signal timing requirements of any new display device, can be stored in the form of digital control codes held within the memory of the display device. The display system programming does not require updating every time a different display device is connected to the output port. Instead, the display adapter can read the new timing requirements from the memory of the new display device for the purpose of generating video and sync signals for correctly driving the new display device. Furthermore, where the display system comprises a multiple mode display device, the display adapter circuit can use the serial link to configure the display device to operate in a desired display mode.

An example of the present invention has been described wherein display information is communicated between the display adapter 92 and the display device 88 by communication logic 95 comprising a serial link 3 which is separate from the lines carrying the video and sync signal from the display adapter 92 to the display device. It will be appreciated however that other communication links and coding methods may be used. Furthermore, the example of the present invention includes a raster-scanned display device. It will be appreciated that the present invention is equally applicable to other display devices such as Liquid Crystal Display device or vector-scanned display devices.

I claim:

1. A display system comprising:

a display device (88) for generating a visual output in response to a plurality of data signals defining the data to be displayed;

a display adapter circuit (92) for generating the data signals in a form specified by control data identifying the display device (88);

an output port (94) for connecting the data signals from the display adapter circuit (92) to the display device (88) and for connecting the control data from the display device (88) to the display adapter circuit (92);

a non-volatile memory (9) located in the display device (88) for storing the control data in the form of a plurality of control codes;

an adapter logic 96 located in the display adapter circuit (92) for initiating commands for reading and writing data to the non-volatile memory; and communication logic (95) for communicating a control code between the memory and the output port (94) in response to a command signal (21) generated by the adapter logic 96.

2. A display system as claimed in claim 1 wherein the communication logic comprises a serial data link (3) for communicating the control code between the display device and the output port, device logic (97) located in the display device for communicating the control code between the memory and the serial data link, and adapter logic (96) located in the display adapter circuit for communicating the control code between the serial data link and the display adapter circuit.

3. A display system as claimed in claim 2 wherein the adapter logic comprises a first serialiser for translating a command signal (21) into a command bit stream (22), a first line driver connected to the output port for communicating the command bit stream (22) to the device logic along the serial link, a first receiver connected to the output port for receiving a control bit stream from the device logic along the serial link, and a first deserialiser for translating the control bit stream into a control code corresponding to the command signal (21).

4. A display system as claimed in claim 3 wherein the first serialiser and the first deserialiser are combined in a single integrated circuit module.

5. A display system as claimed in claim 3 wherein the first line driver and the first receiver are incorporated in a single integrated circuit module.

6. A display system as claimed in claim 2 and further comprising means for configuring the display device to operate in different display modes in response to mode control signals communicated from the adapter logic to the device logic along the serial link.

7. A display device as claimed in claim 2 and further comprising means for adjusting operating parameters of drive circuitry of the display device in response to parameter control signals communicated from the adapter logic to the device logic along the serial link.

8. A display device as claimed in claim 7 and further comprising means for obtaining digital samples of signals at nodes of the drive circuitry and for communicating the samples from the device logic to the adapter logic along the serial link in response to a data request signal communicated from the adapter logic to the device logic along the serial link.

9. A display system as claimed in claim 1 wherein the control codes stored in the memory include digitally encoded data signal timing parameters for the display device.

10. A display system as claimed in claim 2 wherein the device logic comprises a second receiver for receiving the command bit stream (22) from the output port along the serial link, a second deserialiser for translating the command bit stream (22) into the command signal (21), a command decoder for translating the command signal (21) into a memory address for accessing the stored control code, a second serialiser for translating the control code into the control bit stream, a second line driver connected for communicating the control bit stream to the output port along the serial link.

11. A display system as claimed in claim 10 wherein the second serialiser and the second deserialiser are combined in a single integrated circuit module.

12. A display system as claimed in claim 10 wherein the second line driver and the second receiver are incorporated in a single integrated circuit module.

13. A display system comprising:

a display device for generating visual displays in response to data and control signals defining the data to be displayed;

a memory means located in said display device for storing characteristic information representative of different display modes in which said display device can be operated; and a device logic means responsive to commands issued from an adapter logic to extract selected characteristic information from the memory means and forward the characteristic information to said adapter logic whereby the adapter logic uses the characteristic information to generate control signals and data signals compatible with one of the display modes.

14. The display system of claim 13 wherein the characteristic information is stored as a plurality of identification codes representing timing parameters.

15. The display system of claim 13 wherein the timing parameters include sync pulse widths, active video period and blanking intervals.

16. The display system of claim 14 wherein the identification code includes a coded transfer parameter for indicating the maximum rate at which the data can be forwarded to the display device.

17. The display system of claim 13 wherein the memory means includes a non-volatile memory.

18. The display system of claim 17 wherein the non-volatile memory (NVM) includes a program NVM and a personality NVM.

19. The display system of claim 17 further including a display I/O means coupled to the program NVM and a drive circuitry coupled to the display I/O.

20. In a computer system having a display device for displaying visual information, a display adapter, for processing the information to be displayed on said display device, comprising:

a device driver for generating a command code in response to program instruction;

first means coupled to the device driver and for translating the command code into command bit streams;

second means coupled to the first means and for transmitting the command bit stream to said display device;

third means for receiving a response bit stream transmitted from the display device as a result of receiving the command bit stream; and fourth means for decoding the response bit stream and using its contents to generate data and control signals compatible with a display mode of said display device.

* * * * *